United States Patent [19]

Puzey

[11] Patent Number: 4,484,714

[45] Date of Patent: Nov. 27, 1984

[54] BEAM MOUNTED CORE ENVELOPER

[75] Inventor: Brian S. W. Puzey, Kennesaw, Ga.

[73] Assignee: The Black Clawson Company, Middletown, Ohio

[21] Appl. No.: 516,226

[22] Filed: Jul. 22, 1983

[51] Int. Cl.[3] ..... B65H 19/26; B65H 19/28

[52] U.S. Cl. ..... 242/56 A

[58] Field of Search ..... 242/56 A, 56 R, 64, 242/67.1 R, 56.6

[56] References Cited

U.S. PATENT DOCUMENTS

| | | | |
|---|---|---|---|
| 2,586,832 | 2/1952 | Kohler | 242/56 A |
| 2,586,833 | 2/1952 | Kohler | 242/56 A |
| 2,787,427 | 4/1957 | Marczincsin | 242/56 A |
| 3,478,975 | 11/1969 | Penrod | 242/64 |
| 4,171,780 | 10/1979 | Bugnone | 242/56 A |
| 4,360,170 | 11/1982 | Kuklies et al. | 242/56 R |

FOREIGN PATENT DOCUMENTS

| | | | |
|---|---|---|---|
| 2203696 | 8/1973 | Fed. Rep. of Germany | 242/56 A |

*Primary Examiner*—John M. Jillions

*Attorney, Agent, or Firm*—Biebel, French & Nauman

[57] ABSTRACT

A core enveloper, for applying a web of paper, plastic or the like, to a new core, for example, on an automatic web winder, is adapted to provide for web severing and core wrapping in either of two directions of wrap. The enveloper arms including the enveloper roll, the rider roll, the cut-off knife and web transfer brush are mounted on a subframe comprising a beam which, in turn, is rotatably mounted on a support frame and is thus movable, by a drive motor, to present the core in either an "over" or an "under" position with respect to the enveloper. The axis of rotation of the beam intersects a centerline through the core so that the geometry of the enveloper, with respect to the core, remains unchanged in either of the operating positions of the enveloper.

3 Claims, 5 Drawing Figures

BEAM MOUNTED CORE ENVELOPER

BACKGROUND OF THE INVENTION

This invention relates to envelopers for web winding machines, and more particularly to an enveloper assembly which is arranged to accomplish core envelopment in either of two winding directions.

The automatic partial wrapping of a core by a web, in an automatic roll changer apparatus, has been known for many years. The patent of Kohler et al, U.S. Pat. No. 2,586,833 issued Feb. 26, 1952 discloses enveloper apparatus in combination with a roll changing winder to provide for the continuous operation by means of which a continuously moving web of material, such as paper, plastic, or the like, may be transferred from a completed roll to a new core, so that successive rolls of web may be formed without interrupting the winding operation. A later improved form of enveloper is shown in Marczincsin, U.S. Pat. No. 2,787,427 issued Apr. 2, 1957, in which a web was caused to wrap considerably more than one-half of the circumference of the core, and the apparatus included a cutting knife in which the transfer of the web was affected by a knife which moved in the space between the core and a guiding member, in the direction of rotation of the core, so that the web was severed in this space and the resulting leading end of the web was started on the new core. A still more recent version of an enveloper is shown in Penrod, U.S. Pat. No. 3,478,975 issued Nov. 18, 1969, in which the enveloper is shown in combination with a turret winder.

In the various arrangements shown in the above-identified patents, the enveloper was capable of wrapping the web about the core in one direction of rotation only. In those instances where the core was to be operated in opposite direction, so that the other side of the web was turned out in winding, it was necessary to employ an auxiliary or second core enveloper assembly for that purpose. This resulted in a highly cluttered area at the roll change station, and provided apparatus which was difficult to access, thread, and maintain.

SUMMARY OF THE INVENTION

This invention is directed to a roll enveloper capable of accomplishing core enveloping, in combination with a winder apparatus, in either of two winding directions. For this purpose, the enveloper mechanism is mounted on a rotating beam, and the beam, in turn, is mounted for rotation about a generally horizontal axis, so that the enveloper assembly may be rotated through approximately 180° from an "over" to an "under" position, as desired. In this manner, the enveloper may selectively operate in either of two directions of core rotation, as desired.

The terms "over" and "under" as used herein refers to the position of the new core 20 in relation to the enveloper mechanism. Thus, the term "over" refers to the situation where the core is spaced above the enveloper arms, and the term "under" refers to the opposite condition, in which the core is spaced below the enveloper arms.

The advantage of this arrangement is one of reduced initial cost and reduced maintenance, as compared to an installation having a two directional roll changer and two enveloper assemblies. Additionally, a more uncluttered field in the roll change area is realized, permitting easier access for threading and maintenance.

It is accordingly an important object of this invention to provide a single enveloper assembly which is operable in either of two directions of core rotation. A further object of the invention is the provision of an enveloper assembly mounted on a rotating beam, which beam may be indexed in either of two positions, approximately 180° apart, for presenting the enveloper assembly in either an "over" or an "under" position, as required.

For this purpose, the axis of rotation of the beam substantially intersects the axis of the empty core to be enveloped, so that the relationship of the enveloper parts to the core does not materially change when changing from one direction to the other.

These and other objects and advantage of the invention will be apparent from the following description, the accompanying drawings, and the appended claims.

DESCRIPTION OF PREFERRED EMBODIMENT

Figure 1:
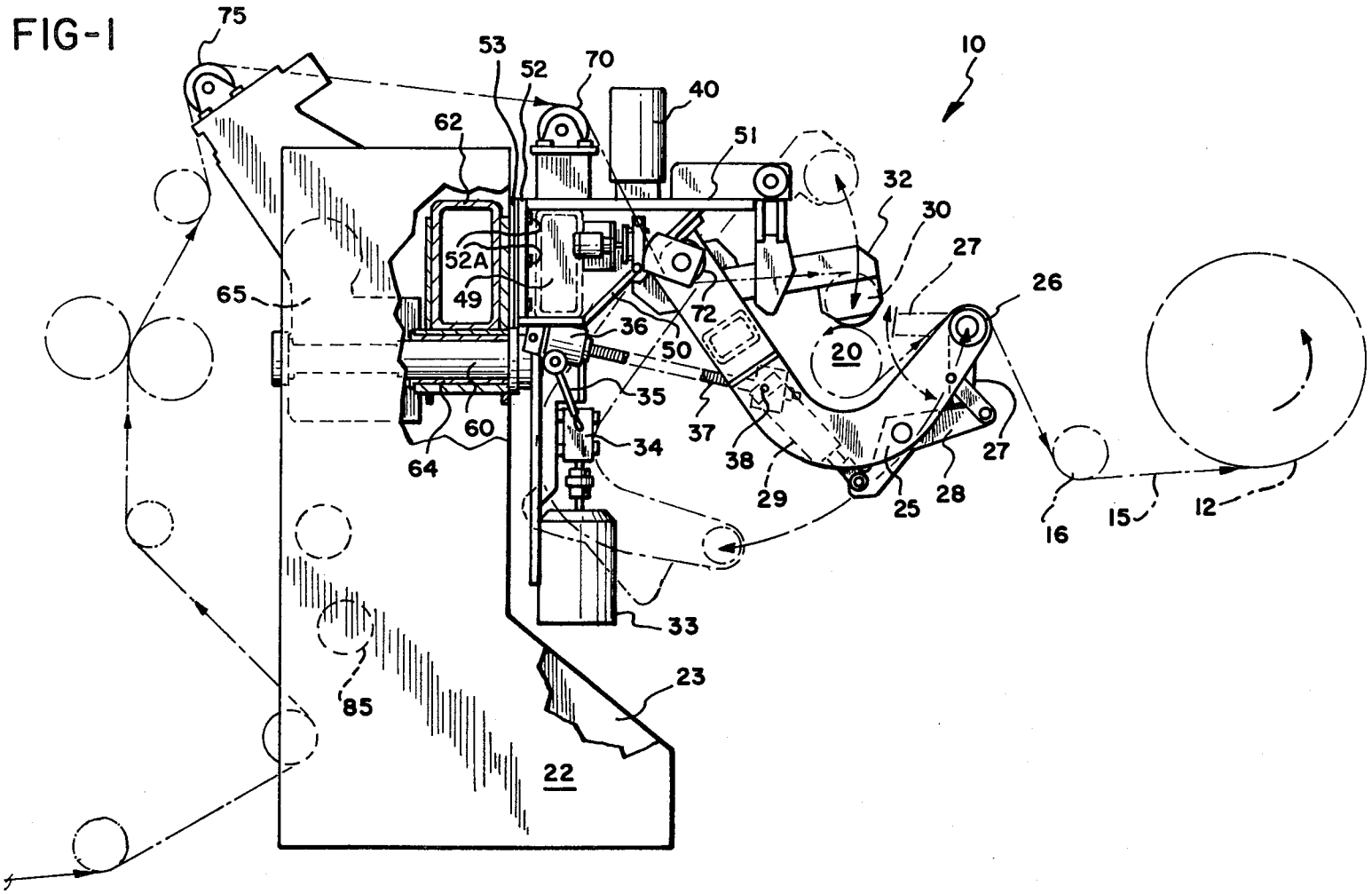
FIG. 1 is a side elevation, partially diagrammatic, of an enveloper made in accordance with this invention, showing the enveloper beam mechanism in the "over" position, and showing in outline form the position of certain of the winder components with which the enveloper may typically be used.

Referring to the figures of the drawing which illustrate a preferred embodiment of the invention, a core enveloper is illustrated generally at 10 as being positioned in line with a turret-type winder. The turret type winder is shown only diagrammatically since the winder mechanism itself forms no part of the invention. Such a winder has turret arms which support a winding roll illustrated at 12 with a web 15 leading thereto over a guide roll 16. The web 15 is also shown as being partially enveloped about a new core 20 in the process of being cut and transferred to the core by the enveloper 10.

The core enveloper of the present invention may be used with turret-type winders in which a rider roll associated with the enveloper mechanism remains with the building roll throughout most of the building operation, until the roll or bundle has achieved a predetermined diameter, at which time the turret is indexed. The indexing movement of the turret carries the respective arms through 180° of rotation, and brings a new core having previously been placed on the empty arms into winding position, and at the same time carries the now nearly completed bundle to the opposite or unloading position. Such turret winders, as disclosed for example in the U.S. patent of Penrod, U.S. Pat. No. 3,478,975, previously mentioned, are provided with auxiliary rider or pressure rolls on the winder, and these auxiliary pressure rolls take up the function of the rider roll on the enveloper, during indexing and web transfer. Following indexing, the web may then be severed from the fully wound roll and the free end of the severed web applied to the new core which has now been brought up to speed by a drive motor. The fully wound bundle may now be removed and a new core placed in readiness. Also, the apparatus of this invention is particularly adapted for use with the turret-type winder disclosed and claimed in the copending U.S. application of Richard S. Tetro, Ser. No. 325,444 filed Nov. 27, 1981, now U.S. Pat. No. 4,431,140 and assigned to the same assignee as this invention. In the Tetro application, the turret mechanism is also provided with arms which carry pressure rolls, but in that application, the empty turret arms are first indexed to the position adjacent the enveloper for loading a new core thereon.

Referring to FIG. 1, the fully wound roll 12 has already been moved to its second position, by the turret winder, and the new core 20 has already been placed on the empty turret arms, either at the position shown in FIG. 1 or at the position now occupied by the roll 12 prior to indexing, according to the type of winder used. During indexing, the rider roll is fully retracted, as are the enveloper arms and other parts of the enveloper. At the position of the new core 20 shown in FIG. 1, it will have already been brought up to line speed by a spindle drive mechanism prior to engagement of the core 20 with the web 15. In FIG. 1, the enveloper parts which are shown in full line correspond to the operative position of the enveloper during web severing and web transfer on the core, and the position of the parts shown in broken line show the retracted position of the enveloper arms as well as the retracted position of the rider or pressure roll.

The enveloper 10 includes the usual side frames 22 and 23 with the enveloper mechanism supported thereon. Thus, the enveloper mechanism itself includes a pair of primary curved enveloper arms 25 and an enveloper roll 26 carried at the remote ends of the arms for engagement with the web 15 to cause the same partially to wrap the new core 20, a combination cut-off knife and brush 27 pivotally carried coaxially with the enveloper roll 26 at the remote ends of the arms 25. The knife is actuated by a bell crank 28 carried on the arms 25 by knife cylinders 29.

The enveloper roll 26 may advantageously comprise an air greased tube or turning bar, mounted in flanged bushings (not shown), and supported on the arms 25. Such an enveloper roll or turning bar has holes drilled through the surface, in the web wrap area, with air pressure applied thereto which emits sufficient pressure to provide an air film cushion for the web 15 passing thereover. Suitable air under regulated pressure is thus applied to the interior of such an enveloper roll, which positions the web for envelopment about the new core 20 for cut-off and web transfer operation by the knife and brush 27 at the time of roll change.

The enveloper mechanism further includes a rider roll 30 on rider roll support arms 32. The rider roll 30 assures the proper firmness of wrap immediately, with respect to the newly forming or building web about the new core 20, until roll change, at which time as the function of the rider roll may be assumed by an auxiliary rider roll carried on the winder. As shown in FIG. 1, the primary enveloper arms 25 are positioned underneath the core 20, and raised to bring the enveloper roll 26 into engagement with the web 15 to cause the same to wrap the core 20 in the counter-clockwise direction. The movement of the arms from the broken lines is brought about by an enveloper arm motor-brake 33 which drives through a universal drive 34, a pair of outwarding extending drive shafts 35 (FIG. 3) which terminate at the right angle reduction drive 36 which drive jackscrews 37. The jackscrews 37 extend through nuts 38 carried on the arms 25 to effect extension and retraction thereof. The rider roll 30 is controlled by a rider roll lift and loading cylinder 40 by means of which loading on the rider roll may be accurately maintained in accordance with desired conditions.

Figure 2:
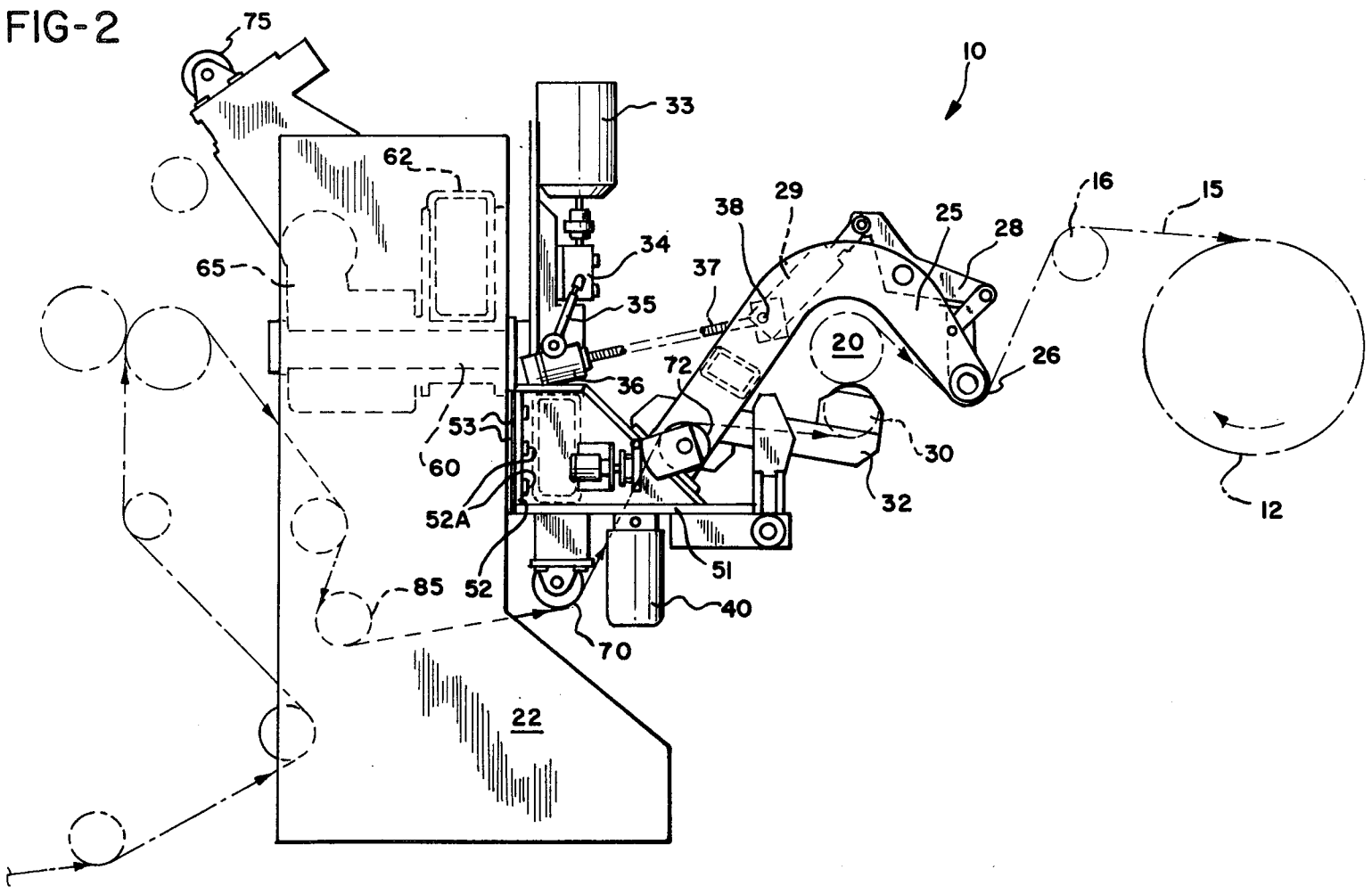
FIG. 2 is a view similar to FIG. 1 but showing the enveloper turret mechanism in the inverted "over" position.
Figure 3:
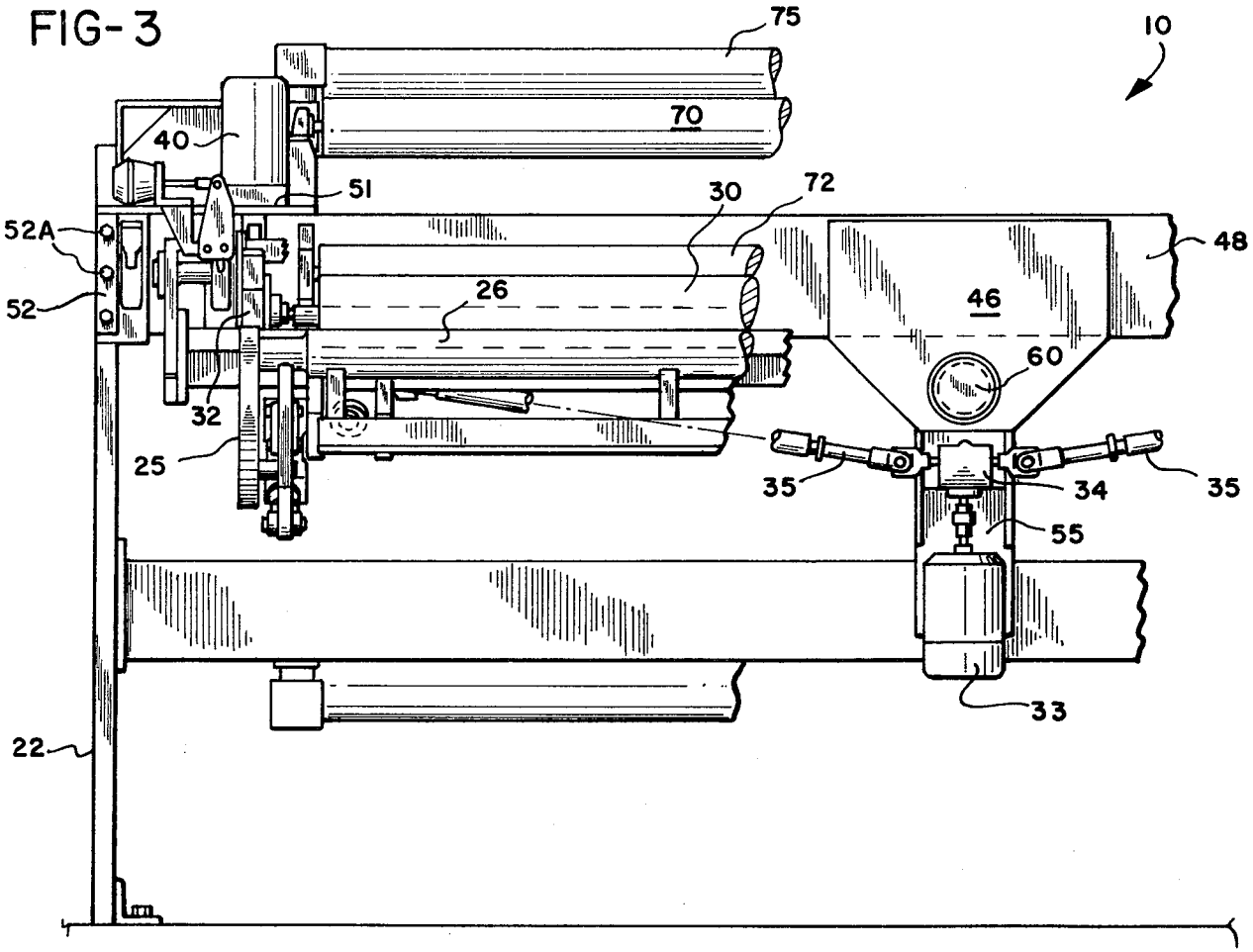
FIG. 3 is a partially broken away front elevation of the enveloper of this invention showing the enveloper rotating beam mechanism in the "over" position corresponding to that shown in FIG. 1.

The entire enveloper mechanism, as identified above, is mounted on rotating beam, through which the mechanism may be rotated together and indexed from the "over" position shown in FIG. 1 to the "under" position shown in FIG. 2. For this purpose, the enveloper mechanism including that associated with the arms 25 and 32, is carried on a common mounting structure in the form of a rotating mechanism 45. The rotating mechanism 45 is shown in FIG. 3 as including a primary support plate 46, a transversely extending beam 48 on the plate. The beam 48 carries end plates 49 and a diagonal arm pivot bearing support plate 50, and top mounting plate 51.

Fixing plates 52 (FIG. 3) are carried on the remote ends of the beam 48 and are normally attached to the side frames 22 and 23 by a plurality of removable mounting bolts **52*a* to secure the beam in a fixed indexed position. One or more shims or spacers 53 (FIG. 2) are positioned between the fixing plate 52 and the adjacent surface of the end frames so that the mounting bolts 52*a*** may be drawn down tightly and the beam accurately positioned.

The arms 25 are mounted on trunnions on the support plates 50, in common with the pivot axis of the rider roll arms 32. The motor-brake 33 is shown in FIG. 3 as being mounted on a depending support plate 55 from the primary support plate 46. All of the parts described are thus mounted together for common rotation upon a shaft 60, carried on a transverse support beam 62 between the side frame 22 and 23. The beam 62 carries a sleeve bushing 64 for rotationally supporting the shaft 60. A gear reduction unit 65 is also coupled to the shaft 60 and provides the motive force for rotating the shaft 60 and the turret mounted thereon through 360°, between respective 180° positions. The horizontal top mounting plate 51, forming part of the turret structure, supports the rider roll loading and lift cylinders 40 which have piston rods, not shown, extending to actuate a remote end of the arms 32. In addition, the plate 51 supports a lead-in idler roll 70, which guides the web through a path, to a pivot idler roll 72 also carried on a common axis with the arms 32 and 25, as mounted on the diagonal support plate 50. The geared reduction drive 65 consists of a reversible electric drive/brake combination by means of which the entire turret and mechanism supported thereon, on the shaft 60, may be rotated between the positions shown in FIGS. 1 and 2.

When the turret is used in the "over" position shown in FIG. 1, the web 15 is brought to the enveloper 10, and over an upper lead-in transducer roll 75, to the lead-in idler 70.

Figure 4:
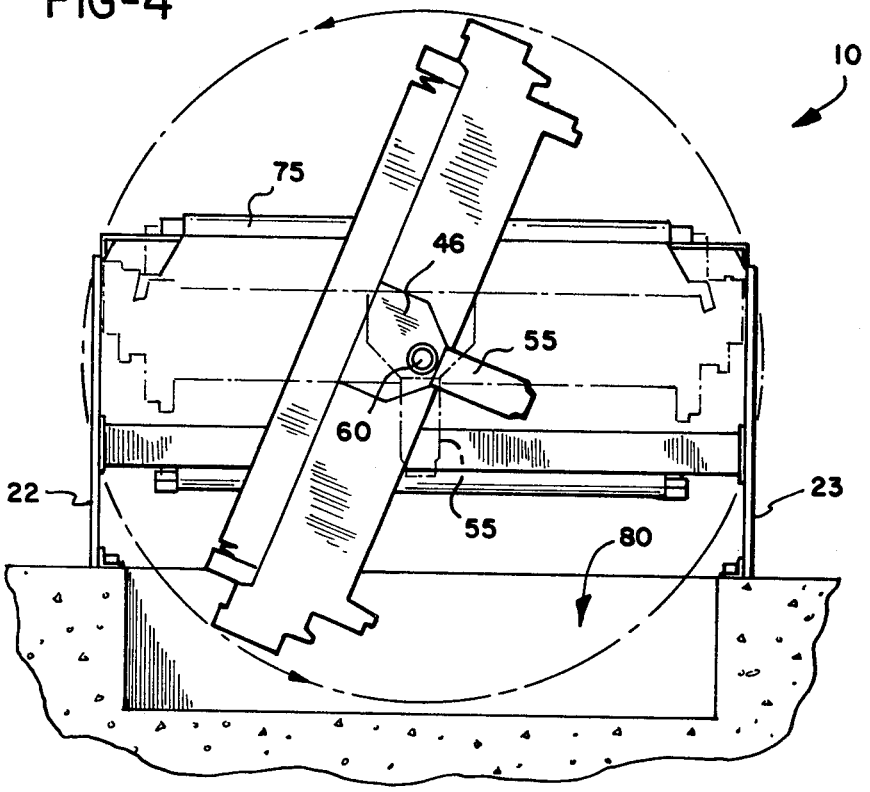
FIG. 4 is a front diagrammatic view showing the enveloper mechanism in outline form and identifying the path of rotation thereof.
Figure 5:
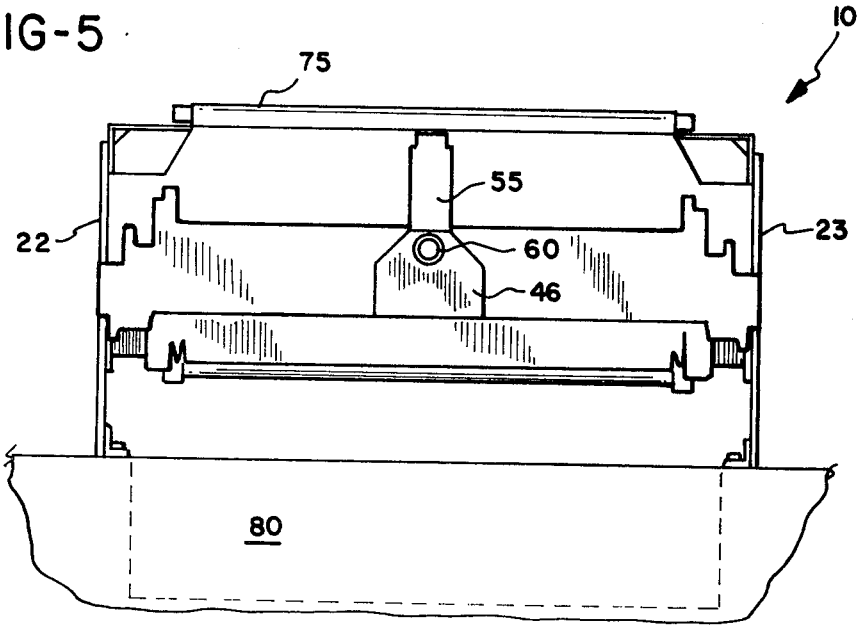
FIG. 5 is a view similar to FIG. 4 showing the enveloper mechanism following completion of 180° of rotation.

As shown in FIG. 1, the "over" position of the enveloper provides for a counter-clockwise wrap of the web 15 about the new core 20. However, when it is desired to reverse the direction of wrap of the web with respect to the core, so as to present the opposite side of the web to the outside, it is only necessary to remove the mounting bolts 52 and the spacers or shims 53, freeing the beam mechanism for rotation. It is understood that the pneumatic and electrical lines to the enveloper should be provided with suitable quick disconnects so that these lines may be readily and easily disconnected prior to indexing of the beam. Prior to such indexing or rotation, it should further be understood that the rider roll 32 will be raised to the fully retracted position, shown in broken lines in FIG. 1, and the enveloper arms 25 will be similarly retracted to the broken line position. Now, the drive motor 65 may be operated to rotate the entire mechanism, by driving the shaft 60, carrying the mechanism about a circular path generally as shown in FIG. 4, for the purpose of inverting the mechanism. Since the radius of the circle of rotation exceeds the height of the shaft 60 above the floor, it is necessary to provide an unobstructed pit 80 between end stands or frames 22 and 23 through which the beam-supported mechanism may freely move during conversion from one position to the other. FIG. 5 represents the outline of the beam mechanism and associated enveloper mechanism, after full inversion to the "under" position as shown in FIG. 2. Following inversion, the pneumatic and electric lines are reconnected, and proper shims 53 are reinserted for aligning the beam, and the retainer bolts 52*a* are reinserted and tightened.

In FIG. 2, the web lead-in path is changed from that shown in FIG. 1 to a lower lead-in transducer roll 85 and over the lead-in idler roll 70 which is now inverted from the position shown in FIG. 1. The primary enveloper arms are now positioned in overlying relation to the core 20. It will be seen that the axis of the shaft 60 substantially coincides with a center line through the core 20, in the core starting or loading position as shown in FIGS. 1 and 2, so that the relative spatial relationship of the enveloper mechanism carried on the rotating beam remains unchanged with respect to the center line of the core.

Accordingly, a single enveloper mechanism may be used for web start-ups in either of two winding directions, in conjunction with a winder, simply by properly postioning the assembly carrying the movable enveloper components, to the under or over positions, as respectively shown in FIGS. 1 and 2.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A core enveloper adapted for applying a web to a new core on a winder, providing for either clockwise or counter-clockwise wrap of the web on the core, comprising:

a rider roll engageable with a web on said core, a pair of enveloper arms carrying therebetween an enveloper roll movable by said arms to deflect a web over said core and cause said web partially to wrap said core in one direction of rotation, knife means mounted on said arm for severing said web including deflector means for causing the leading end of the web to engage said core, a support frame, a beam rotatably mounted on said support frame, said arms at said rider roll being pivotally mounted on said beam for rotation therewith between an upper position in which said enveloper roll causes said web to wrap said core in one direction and a lower position in which said enveloper roll causes said web to wrap said core in the opposite direction, the axis of rotation of said beam intersecting the axis of said core so that the relative relation between said rolls and said core is maintained in each of said beam positions.

2. A core enveloper adapted for applying a web to a new core on a turret winder, providing for either clockwise or counter-clockwise wrap of the web on the core, comprising:

a rider roll engageable with a web on said core, a pair of enveloper arms carrying therebetween an enveloper roll movable to deflect a web over said core and cause said web partially to wrap said core in one direction of rotation, knife means mounted on said arms for severing said web, a support frame, beam means rotatably mounted on said support frame, said arms and rider roll being mounted on said beam means for rotation therewith for indexing between one position in which said enveloper roll causes said web to wrap said core in one direction and an inverted position in which said enveloper roll causes said web to wrap said core in the opposite direction.

3. In combination with a turret-type winder, a core enveloper adapted for severing a web leading to a wound roll and for applying the free leading end thereof to a core on such winder, and adapted to apply such web to such core in either of two directions of winding, comprising:

a frame having a pair of end stands and a transverse support therebetween, a transverse beam, means rotatably mounting said beam on said transverse support between said end stands, the axis of rotation of said beam positioned on a line which substantially intersects an axis through the center line of said core prior to web transfer, an enveloper mechanism mounted on said beam including a pair of enveloper arms, an enveloper roll carried by said arms and movable by said arms to engage and deflect the web and partially to wrap the web about said core, knife and web transfer means mounted on said arms and operable for severing said web and simultaneously moving the free leading end thereof against said core, a pair of rider roll arms on said beam, a rider roll mounted on said rider roll arms engageable with said core and the web thereon for excluding air from said core during initial winding, said beam with said arm pairs mounted thereon being movable between 180° positions for presenting said enveloper arms at corresponding positions either above or below said core providing for envelopment in either of two directions of rotation of said core.

* * * * *